US007018281B2

(12) United States Patent
Yahav

(10) Patent No.: US 7,018,281 B2
(45) Date of Patent: Mar. 28, 2006

(54) SHARPENING APPARATUS

(75) Inventor: Shimon Yahav, Rehovot (IL)

(73) Assignee: Gotit Ltd., Rehovot (IL)

( * ) Notice: Subject to any disclaimer, the term of this patent is extended or adjusted under 35 U.S.C. 154(b) by 0 days.

(21) Appl. No.: 10/505,766

(22) PCT Filed: Feb. 27, 2003

(86) PCT No.: PCT/IL03/00150

§ 371 (c)(1),
(2), (4) Date: Aug. 26, 2004

(87) PCT Pub. No.: WO03/076138

PCT Pub. Date: Sep. 18, 2003

(65) Prior Publication Data

US 2005/0164618 A1 Jul. 28, 2005

(30) Foreign Application Priority Data

Mar. 10, 2002 (IL) ..... 148599

(51) Int. Cl.
*B24D 15/08* (2006.01)

(52) U.S. Cl. ..... 451/439; 76/84; 76/86

(58) Field of Classification Search ..... 451/439, 451/523, 524; 76/84, 86; 30/138; 7/120
See application file for complete search history.

(56) References Cited

U.S. PATENT DOCUMENTS 602,790 A * 4/1898 Williams ..... 76/86
1,477,488 A * 12/1923 Holland ..... 30/138
2,030,161 A * 2/1936 Von Der Lippen ..... 76/86
2,124,646 A 7/1938 Barsch
2,291,128 A * 7/1942 Yarrow ..... 30/138
2,295,859 A * 9/1942 Murray ..... 451/558
2,337,158 A * 12/1943 Frank ..... 30/138
2,566,909 A * 9/1951 Cristoval ..... 451/463
2,700,819 A 2/1955 Mason
3,032,938 A 5/1962 Voll
3,846,909 A * 11/1974 Clarke ..... 30/138
4,494,339 A * 1/1985 Pittaway ..... 451/540
4,654,968 A * 4/1987 Gatley et al. ..... 30/138
4,672,778 A * 6/1987 Rieser ..... 451/486
5,245,789 A * 9/1993 Rees et al. ..... 451/198
6,027,790 A 2/2000 Rasmussen et al.
6,769,327 B1 * 8/2004 Henry ..... 76/86

OTHER PUBLICATIONS

Definition "Sharpening Steel" Copyright © 1995 by Barron's Educationa Series from "The New Food Lover's Companion", 2nd Ed. by Sharon Tyler Herbst.*

* cited by examiner

*Primary Examiner*—M. Rachuba
(74) *Attorney, Agent, or Firm*—Dekel Patent Ltd.; David Klein

(57) ABSTRACT

The sharpening apparatus of the present invention preferably comprises a hand sharpener that may be assembled or mounted on the knife (e.g., sold mounted on the knife by the knife manufacturer or purchased separately and mounted on the knife by the end-user), and which may remain on the knife after sharpening.

13 Claims, 5 Drawing Sheets

SHARPENING APPARATUS

FIELD OF THE INVENTION

The present invention relates generally to apparatus for sharpening knives and the like.

BACKGROUND OF THE INVENTION

Many devices are known for sharpening knives, razors and other sharp instruments and tools. The sharpeners range from whetstones to grinding stones to rubbing straps.

A common problem associated with sharpening knives and the like is the need for properly orienting the sharpener with the blade of the knife. Proper orientation forms a sharp, clean edge with a correctly formed blade angle. However, many people do not possess the skill or experience in holding the sharpener at the correct angle with respect to the blade. This may result in a poorly sharpened blade.

SUMMARY OF THE INVENTION

The present invention seeks to provide an improved sharpener, which may be used to sharpen knives, razors and other sharp instruments and tools. The sharpening apparatus of the present invention preferably comprises a hand sharpener that may be assembled or mounted on the knife (e.g., sold mounted on the knife by the knife manufacturer or purchased separately and mounted on the knife by the end-user), and which may remain on the knife after sharpening.

The sharpener may be manufactured at a significantly low cost from many kinds of materials, such as but not limited to, metals, plastics, ceramics, composite fiber materials and others, or any combination thereof. The sharpener may be constructed with a plurality of sharpening elements having shapes, such as but not limited to, leaves, wires, tongues or teeth, or any combination thereof. The sharpening elements may be flexible and elastic to "hug" any shape of blade during sharpening. The sharpening elements may be roughened, or may be coated with an abrasive material, such as but not limited to, alumina, diamond powder or boron or silicon carbide, or any combination thereof. The sharpener may sharpen the knife with forward and backward strokes, similar to the motion used with a sharpening strap or stick. However, in contrast with such prior art sharpeners, each forward or backward stroke of the sharpener may be equivalent to many such movements of sharpening straps or sticks. This may be due to the multiple sharpening elements and to the multiple points of contact between the knife blade and the sharpening elements. The sharpener may have a gripping handle facing the back or side of the knife blade.

The sharpener may be used to sharpen many varieties, shapes and sizes of knives, including, but not limited to, smooth blades, serrated blades, kitchen knives, steak knives, fish knives, machetes, diver's knives, hunter's knives, camping knives, pocketknives, and surgical blades, just to mention some. The sharpener may align itself at the correct sharpening angle with respect to the blade, without dependency on the skill or experience of the user, nor on the shape, size or type of knife.

The sharpener may sit on the back of the knife blade near the handle after use, and does not interfere with use of the knife. The sharpener may be held, fastened or locked in place on the back of the knife blade, thereby assuring that the sharpener does not inadvertently fall off the knife when not in use.

It is noted that the term "knife" as used throughout the specification and claims encompasses any sharp instrument or tool, such as but not limited to, knives or razors, for example.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENT

Figures 1, 2:
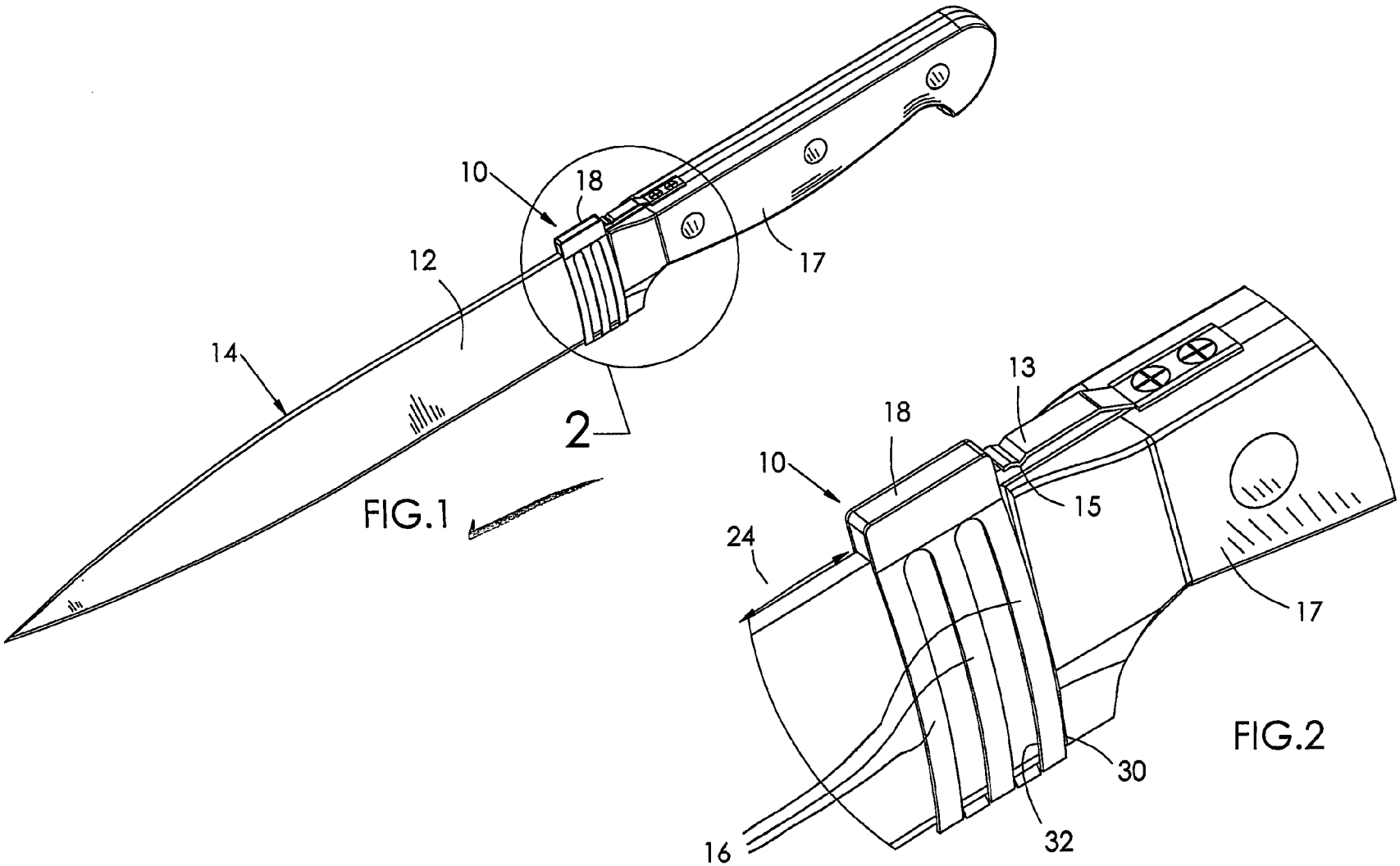
FIG. 1 is a simplified pictorial illustration of sharpening apparatus mounted on a knife, constructed and operative in accordance with an embodiment of the present invention.
FIG. 2 is a more detailed view of the sharpening apparatus of FIG. 1.

Reference is now made to FIGS. 1 and 2, which illustrate sharpening apparatus, constructed and operative in accordance with a preferred embodiment of the present invention.

The sharpening apparatus preferably includes a hand sharpener 10 mountable and slidable on a knife blade 12 of a knife 14. Knife 14 may be of any shape and size, including, but not limited to, a kitchen knife, steak knife, fish knife, machete, diver's knife, hunter's knife, camping knife, pocketknife, and surgical blade, which are just some of the possibilities. Knife blade 12 may be smooth or non-smooth, e.g., serrated.

Figure 7:
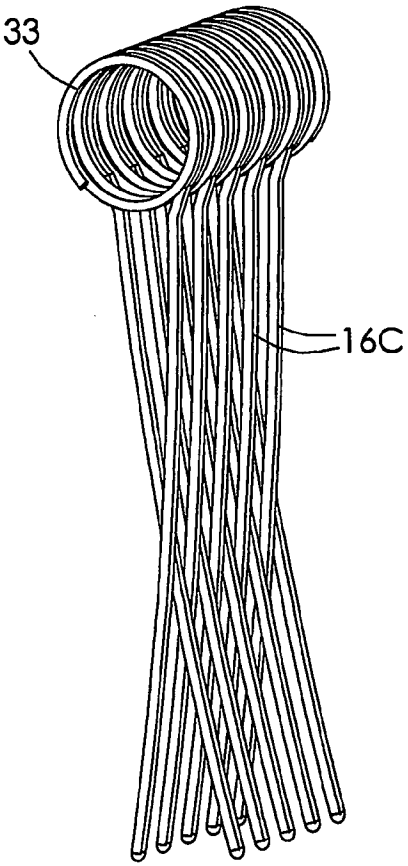
FIG. 7 is a simplified pictorial illustration of sharpening apparatus, constructed and operative in accordance with yet another embodiment of the present invention, comprising sharpening elements shaped like flexible springs.
Figure 6:
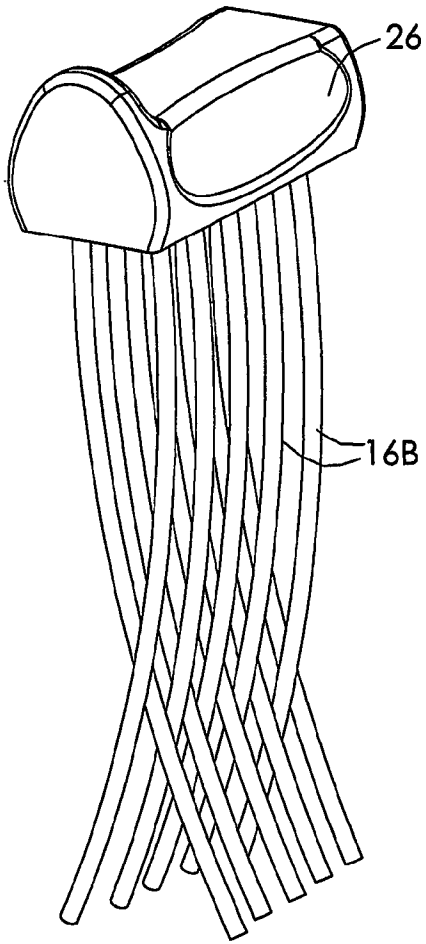
FIG. 6 is a simplified pictorial illustration of sharpening apparatus, constructed and operative in accordance with another embodiment of the present invention, comprising sharpening elements shaped like wires.
Figure 5:
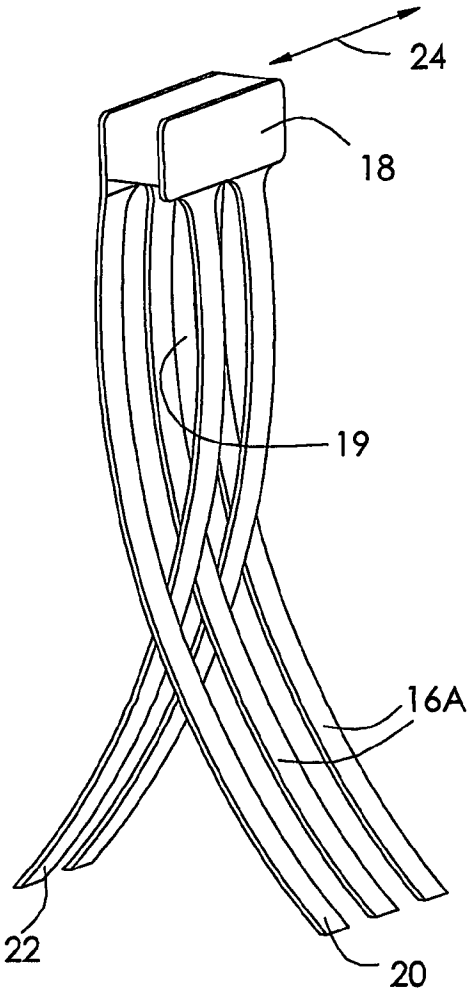
FIG. 5 is a simplified pictorial illustration of sharpening apparatus, constructed and operative in accordance with an embodiment of the present invention, comprising sharpening elements shaped like elongate tongues or fingers.

The hand sharpener 10 preferably comprises a plurality of flexible sharpening elements 16 adapted to rub against the knife blade 12. Referring to FIGS. 5–7, the sharpening elements 16 may have a variety of shapes, such as but not limited to, leaves, tongues, fingers or teeth (as seen in FIG. 5 and designated 16A), wires (as seen in FIG. 6 and designated 16B), or springs (as seen in FIG. 7 and designated 16C), or any combination thereof. The term "tongue"

is used throughout the specification and claims as a general term for any of these shapes. Accordingly, referring again to FIGS. 1 and 2, the sharpening elements 16 may comprise elongate tongues extending from a glider portion 18, which slides along knife blade 12, e.g., along the back of the blade. The sharpening elements 16 may be roughened, or may be coated with an abrasive material, such as but not limited to, alumina, diamond powder or boron or silicon carbide, or any combination thereof. The sharpening elements 16 preferably have a plurality of knife sharpening surfaces, such as leading and trailing edges 30 and 32 of each tongue, or the surface of the tongue facing and contacting the knife blade 12.

The sharpening elements 16 are preferably spaced from one another so as to define a space 19 for passing therethrough the knife blade 12, as seen best in FIG. 5. The sharpening elements 16 preferably overlap to form a boundary of the space 19 for passing therethrough knife blade 12. The sharpening elements 16 may be arranged in opposing pairs of a first tongue (an example of which is indicated by reference numeral 20 in FIG. 5) and a second tongue 22 offset longitudinally one from another along a longitudinal axis 24 of glider portion 18. There may be an odd or even number of the sharpening elements 16.

Figure 3:
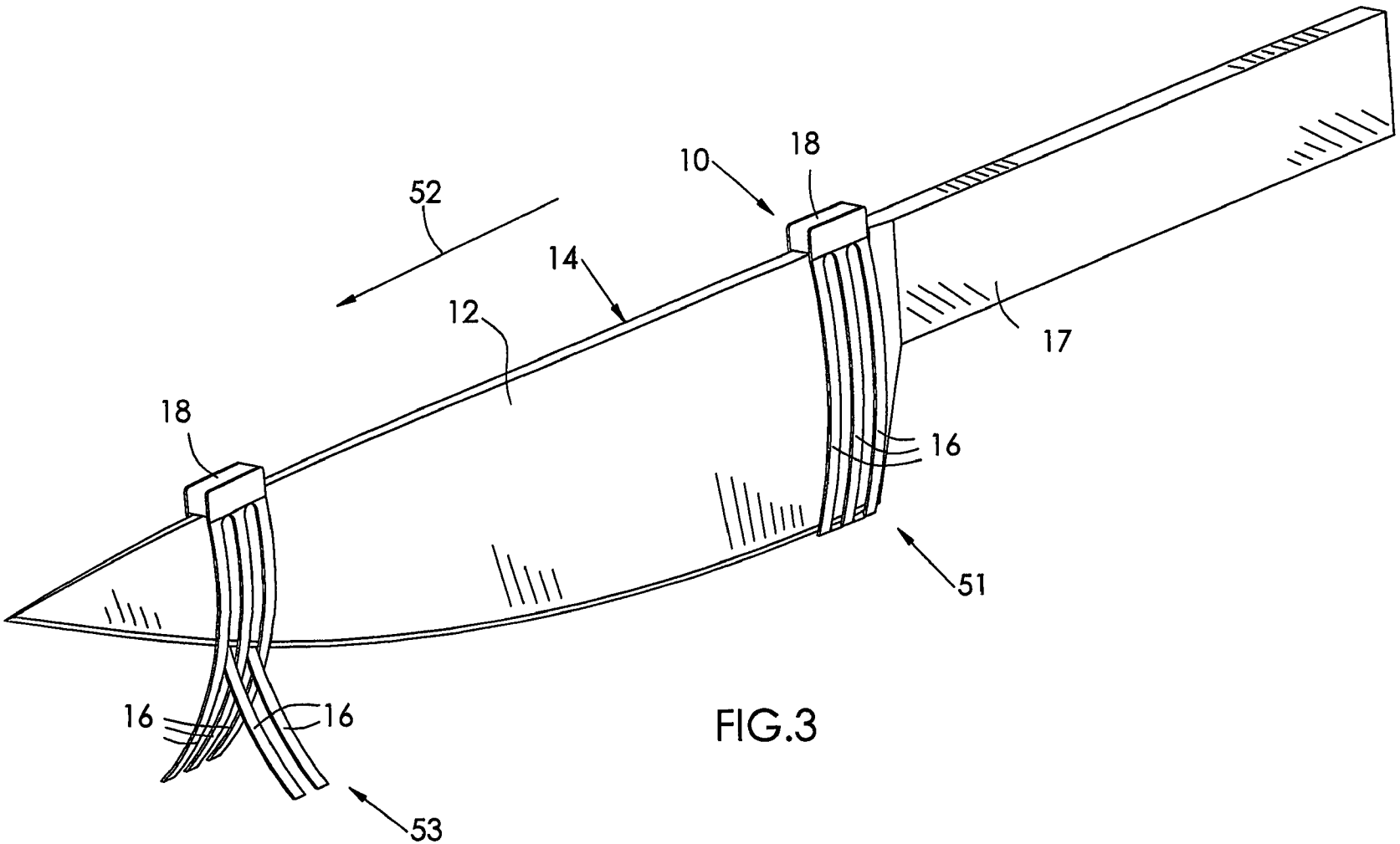
FIG. 3 is a simplified pictorial illustration of the sharpening apparatus of FIG. 1 in two different positions on a knife blade, showing sharpening elements that flexibly conform to the shape of the blade.

Reference is now made to FIG. 3. The sharpening elements 16 may be flexible and elastic to conform to any shape of the knife blade 12 during sharpening. For example, hand sharpener 10 may be positioned as indicated by arrow 51 near a handle 17 of knife 14. The lower end of the sharpening elements 16 contact the knife blade 12 and are adapted to sharpen the blade 12. The hand sharpener 10 may be moved along the blade 12 in the direction of arrow 52, to the position indicated by arrow 53 at the end of the blade 12. It may be seen that the flexibility or elasticity of the sharpening elements 16 ensures that the sharpening elements 16 overlap and remain in sharpening contact with blade 12 throughout movement along blade 12. The spring configuration of the sharpening elements 16 shown in FIG. 7 may be particularly effective to pinch the blade 12 along the entire length of the blade 12.

Glider portion 18 may be provided without any covering as shown in FIG. 5. Alternatively, as seen in FIG. 6, glider portion may comprise a gripping handle 26 for grasping and sliding hand sharpener 10 along the knife blade 12. In the embodiment of FIG. 7, glider portion 18 may comprise coils 33 of the spring-like sharpening elements 16C. Coils 33 may be covered by a handle as well, if desired.

The sharpener 10 may sharpen the knife 14 with forward and backward strokes, generally along the length of the knife blade 12 (directions indicated by axis 24 in FIG. 2). Each forward or backward stroke of the sharpener 10 may be equivalent to many movements of prior art sharpeners. For example, in the embodiment illustrated in FIGS. 1 and 2, there are a total of at least 10 sharpening surfaces and/or edges, which means that each forward or backward stroke of the sharpener 10 may be equivalent to at least 10 movements of prior art sharpeners. In the embodiment of FIG. 6 there are at least 20 sharpening surfaces.

Reference is now made again to FIG. 2. The hand sharpener 10 may be secured to handle 17 of knife 14. For example, a clasp 13, secured to handle 17, may be snappingly received in a groove 15 formed in an extension of glider portion 18.

Figures 4A, 4B:
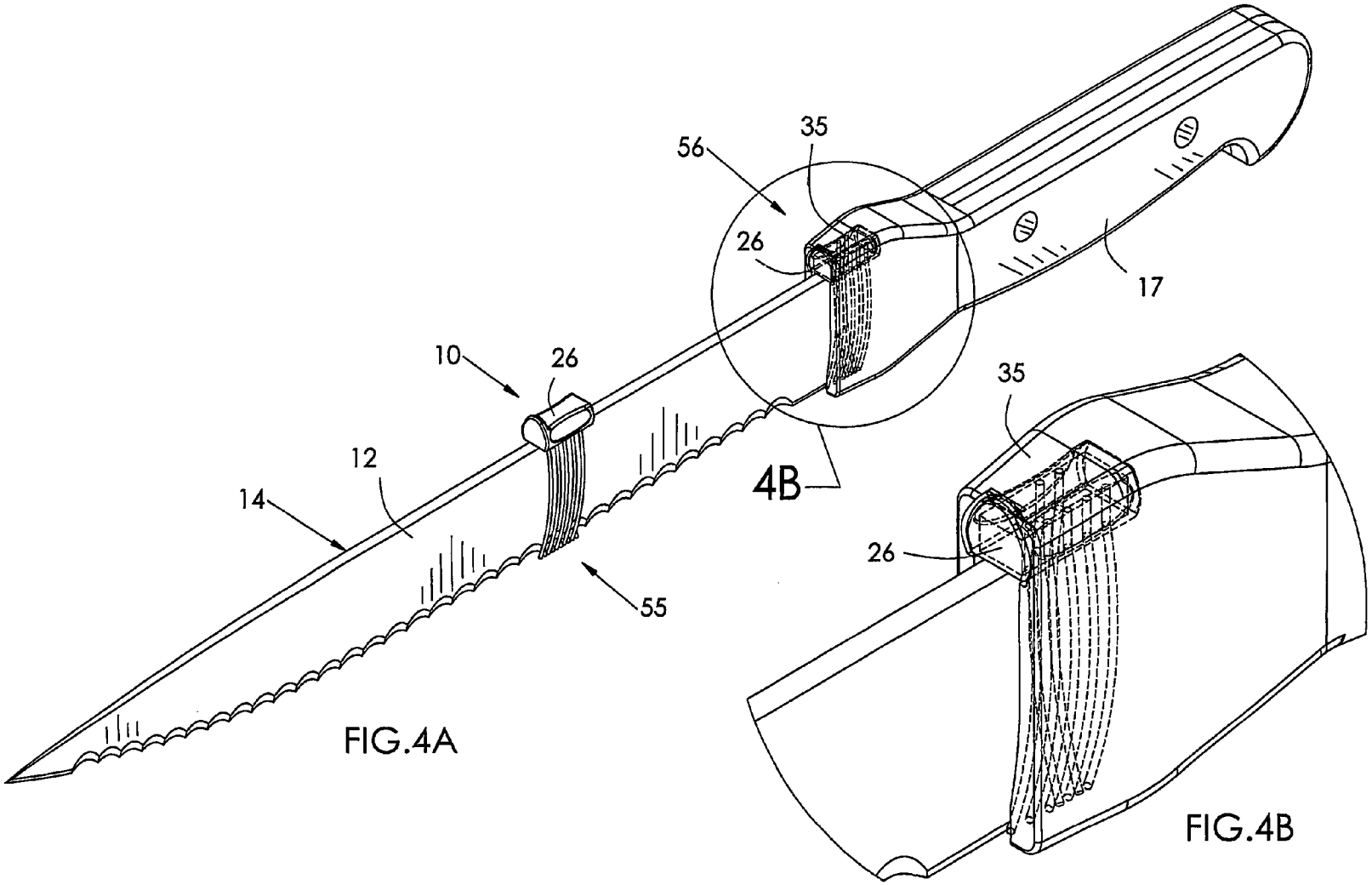
FIG. 4 is a simplified pictorial illustration of sharpening apparatus, constructed and operative in accordance with an embodiment of the present invention, wherein the sharpening apparatus is storable in a recess in the knife handle.

Another possibility of securing hand sharpener 10 to knife 14 is illustrated in FIGS. 4A and 4B. Hand sharpener 10 may be slid from an operable position (indicated by arrow 55) towards handle 17 and conveniently stored in a recessed compartment 35 formed in handle 17, as indicated by reference arrow 56. Gripping handle 26 may slightly protrude from recess compartment 35 so that the hand sharpener 10 may be easily pulled out of recessed compartment 35 for sliding along blade 12.

Figure 9:
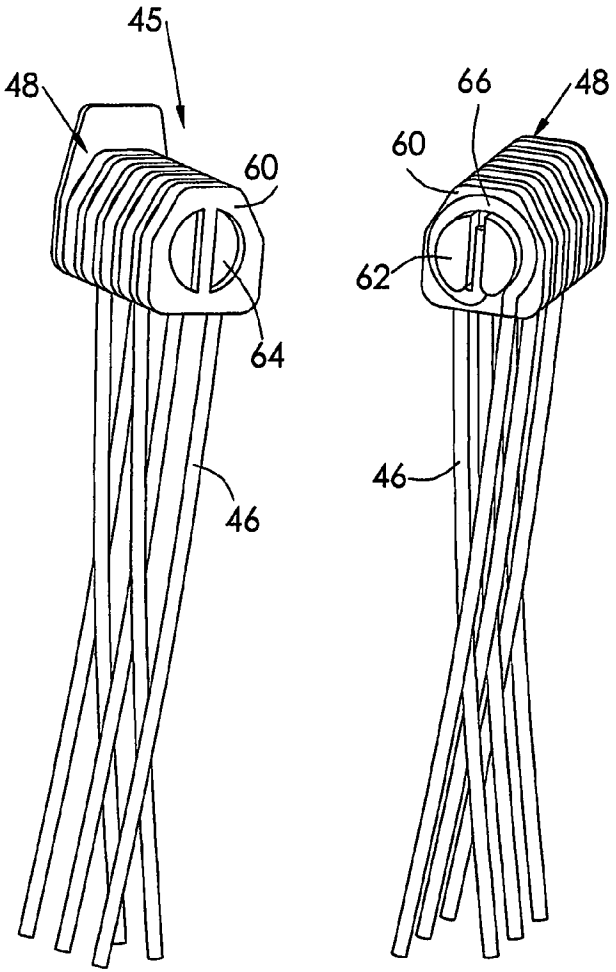
FIG. 9 is a simplified pictorial illustration of two portions of the sharpening apparatus of FIG. 8, showing male and female connectors that may form the modular construction of the sharpening apparatus.
Figure 8:
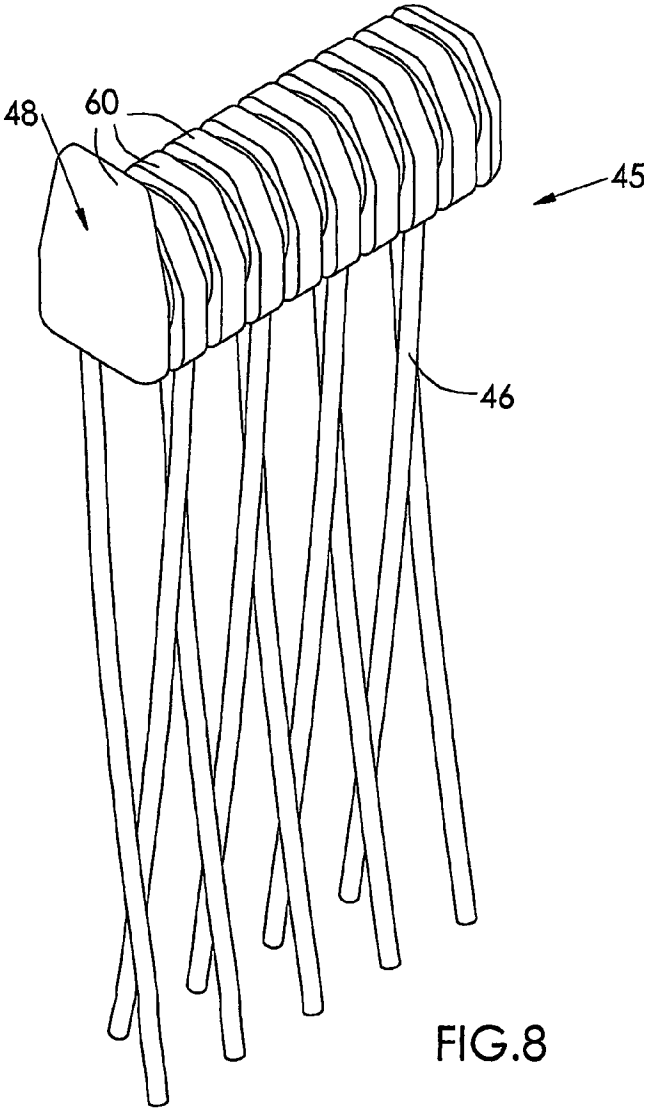
FIG. 8 is a simplified pictorial illustration of sharpening apparatus, constructed and operative in accordance with still another embodiment of the present invention, comprising sharpening elements that are modularly connectable to one another.

Reference is now made to FIGS. 8 and 9, which illustrate sharpening apparatus, constructed and operative in accordance with still another embodiment of the present invention. This embodiment may comprise a hand sharpener 45 comprising sharpening elements 46 that are modularly connectable to one another, such as via a multi-part glider portion 48. For example, glider portion 48 may comprise individual connector portions 60. One side of each connector portion 60 may be formed with a male connector 62 and the other side of connector portion 60 may be formed with a female connector 64. The sharpening elements 46 may comprise spring wires with a coil head 66 that wraps around the connector portion 60, such as around male connector 62. As may be seen in FIG. 9, an end of the wire may be sandwiched between protruding portions of male connector 62. Male connector 62 may be snugly pushed or snapped into female connector 64, thereby locking sharpening elements 46 into place. In such a manner, any length of the hand sharpener 45 may be fashioned.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. Sharpening apparatus comprising:

a hand sharpener mountable and slidable on a knife blade, said hand sharpener comprising a plurality of flexible sharpening elements adapted to rub against a knife blade and spaced from one another so as to define a space for passing the knife blade therethrough, said sharpening elements comprising elongate tongues extending from a glider portion, said glider portion being adapted for sliding along the knife blade, wherein said sharpening elements are modularly connectable to one another, and said glider portion comprises multi-part glider portions having individual connector portions modularly connectable to one another, wherein said sharpening elements and said glider portions are connectable together to form different lengths of said hand sharpener.

2. Sharpening apparatus according to claim 1, wherein said sharpening elements comprise a first tongue and a second tongue offset longitudinally one from another along a longitudinal axis of said glider portion, said first and second tongues being positioned on opposite sides of the longitudinal axis.

3. Sharpening apparatus according to claim 1, wherein said sharpening elements overlap to form a boundary of said space for passing therethrough the knife blade.

4. Sharpening apparatus according to claim 1, wherein said sharpening elements comprise a plurality of knife sharpening surfaces.

5. Sharpening apparatus according to claim 1, wherein said sharpening elements are roughened.

6. Sharpening apparatus according to claim 1, wherein said sharpening elements are coated with an abrasive material.

7. Sharpening apparatus according to claim 1, further comprising a gripping handle extending from said hand sharpener.

8. Sharpening apparatus comprising:

a knife comprising a knife blade; and a hand sharpener slidably mounted on said knife blade, said hand sharpener comprising a plurality of flexible sharpening elements adapted to rub against a knife blade and spaced from one another so as to define a space for passing the knife blade therethrough, said sharpening elements comprising elongate tongues extending from a glider portion, said glider portion being adapted for sliding along the knife blade, wherein said sharpening elements are modularly connectable to one another, and said glider portion comprises multi-part glider portions having individual connector portions modularly connectable to one another, wherein said sharpening elements and said glider portions are connectable together to form different lengths of said hand sharpener.

9. Sharpening apparatus according to claim 8, wherein said hand sharpener is self-aligned at an angle with respect to said knife blade suitable for sharpening said knife blade.

10. Sharpening apparatus according to claim 8, wherein said hand sharpener is fastenable on to said knife.

11. Sharpening apparatus according to claim 8, wherein said knife blade comprises at least one of a smooth blade and a non-smooth blade.

12. Sharpening apparatus according to claim 8, wherein said knife comprises at least one of a kitchen knife, steak knife, fish knife, machete, diver's knife, hunter's knife, camping knife, pocketknife, and surgical blade.

13. Sharpening apparatus according to claim 1, wherein one side of each of said connector portions is formed with a male connector and the other side of the connector portion is formed with a female connector.

* * * * *